US005194040A

United States Patent [19]

Stoney

[11] Patent Number: 5,194,040

[45] Date of Patent: Mar. 16, 1993

[54] SLOT VENTILATORS

[76] Inventor: Arthur Stoney, 10 Fleece Yard, Halstead, Essex C0J 2DA, England

[21] Appl. No.: 678,946

[22] PCT Filed: Aug. 10, 1989

[86] PCT No.: PCT/GB89/00917

§ 371 Date: Apr. 16, 1991

§ 102(e) Date: Apr. 16, 1991

[87] PCT Pub. No.: WO90/02298

PCT Pub. Date: Mar. 8, 1990

[30] Foreign Application Priority Data

Aug. 26, 1988 [GB] United Kingdom ..... 8820336

[51] Int. Cl.[5] ..... E06B 7/02

[52] U.S. Cl. ..... 454/222; 454/274; 454/334

[58] Field of Search ..... 98/41.1, 41.2, 42.2, 98/88.1, 98, 99.6, 99.8, 118; 49/339

[56] References Cited

U.S. PATENT DOCUMENTS

| | | | |
|---|---|---|---|
| 2,207,671 | 7/1940 | King | 98/42.2 X |
| 3,392,658 | 7/1968 | Korff | 98/42.2 X |
| 4,727,797 | 3/1988 | Smith | 98/98 |
| 4,736,677 | 4/1988 | Smith | 98/98 |

FOREIGN PATENT DOCUMENTS

| | | | |
|---|---|---|---|
| 119045 | 3/1970 | Norway . | |
| 136226 | 4/1977 | Norway . | |
| 141351 | 11/1979 | Norway . | |
| 15832 | 3/1906 | United Kingdom | 98/42.2 |
| 1212660 | 11/1970 | United Kingdom . | |
| 1417751 | 12/1975 | United Kingdom . | |
| 1582946 | 1/1981 | United Kingdom . | |
| 36310 | 7/1986 | United Kingdom | 98/42.2 |

*Primary Examiner*—Harold Joyce

[57] ABSTRACT

A slot ventilator (1) comprises an elongate facing strip (7) which is movable on parallel-motion links (12) between a closed position in which it seals a slot (4) in a backing member (3), and a forward, open position. The parallel-motion links (12) are pivotally secured at one end of a rearwardly-extending rib (8) at the rear of the facing strip (7), and at the other end to a pair of parallel rearwardly-extending mounting flanges (5) behind the backing member (3). When the facing strip (7) is in the closed position, the pivotal connection (13) between the link (12) and the flanges (5) is accommodated within a cutout portion (18) of the rib (8), so enabling the overall depth of the ventilator to be reduced.

7 Claims, 2 Drawing Sheets

SLOT VENTILATORS

TECHNICAL FIELD

This invention relates to a slot ventilator, for example for use in a room with a sealed window or double glazing wherein it is desirable to provide ventilation without having to open the window.

BACKGROUND PRIOR ART

Slot ventilators are known but they have always required a substantial dimension perpendicular to the face containing the slot in order to achieve effective opening of the slot by moving a facing strip for closing the slot by movement essentially parallel with the face containing the slot.

For some applications a slot ventilator is desirable with a very short dimension perpendicular to the face containing the slot and that is achieved in accordance with the present invention.

SUMMARY OF THE INVENTION

According to the present invention there is provided a slot ventilator comprising an elongate slotted backing member and an elongate facing strip mounted by a spaced parallel-motion link to the backing member such that longitudinal movement of the facing strip also produces movement thereof towards or away from the backing member between a closed position obstructing a slot in the backing member, and a forward open position; the link being pivoted at one end to a rib extending from the facing strip into the slot, and at the other end to the backing member, the rib being cut away or otherwise shaped to accommodate the pivotal connection between the link and the backing member.

The cutaway enables the pivotal connections respectively to the rib and the backing member to be separated by only a short distance in a direction perpendicular to the plane of the slot while the, or each, link need only be a little longer than the desired amount of opening movement of the facing strip away from the backing member.

Each link is conveniently of "U" cross-section being pivoted to the backing member at the bottom of the "U" and pivoted to the rib at the top of the "U" where the two arms are on either side of the rib. The two arms of the "U" may be closely spaced on either side of the rib to provide an adequate support when the facing strip is in the open position. In spite of the cutaway to accommodate the pivot to the backing member, the rib can be of sufficient extent into the slot to provide adequate engagement surfaces for the arms of the "U" of the, or each, link.

Preferably both the backing member and the facing strip are formed from extruded sections of uniform crosssection, possibly from aluminium or an aluminium alloy or of a suitable plastics material.

DESCRIPTION OF THE DRAWINGS

The invention may be carried into practice in various ways and one embodiment will now be described by way of example with reference to the accompanying drawings in which.

DETAILED DESCRIPTION

Figure 1:
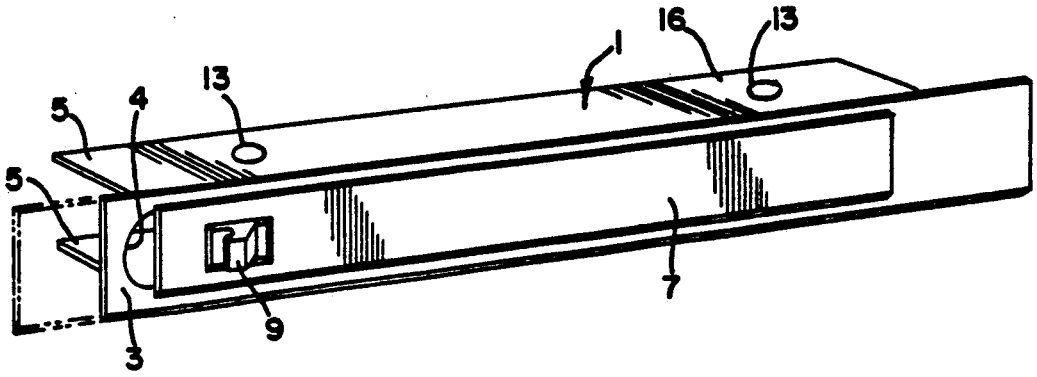
FIG. 1 is a perspective view of a slot ventilator.

The slot ventilator shown generally by reference number 1 comprises a backing member 3, a facing strip 7 and a parallel motion linkage supporting the facing strip on the backing member.

The backing member 3 comprises an elongate strip with a slot 4 extending lengthwise along it, and two parallel flanges 5 extending rearwardly from the slotted strip. The flanges 5 are disposed close to the longitudinal edges of the slotted strip, on either side of the slot 4.

The facing strip 7 has a rearwardly extending longitudinal rib 8 which at all times projects into the slot 4.

The parallel motion linkage comprises two parallel links 12 made of a tough, resilient plastics material such as that sold under the trade mark "Delrin". Each link 12 is "U" shaped, the gap between the arms of the "U" accommodating the rib 8, and the outer faces of these arms lying between and adjacent to or in contact with the flanges 5 of the backing member 3. Pivot pins 13 are provided to connect the ends of the links 12 to the flanges 5, and further pins 14 to connect the free ends of the arms of the links 12 to the rib 8, to allow movement of the facing strip 7 parallel to the backing member 3.

A handle 9 is provided protruding from the facing strip 7 in order to provide more manual purchase.

The links 12 are disposed so as to lie obliquely to the plane containing the axes of the pivot pins 13 when the facing strip 7 lies against the slotted strip portion latter. By applying a force to the facing strip 7, by pushing the handle 9 in the direction of the arrow, (see FIG. 2) the obliquity of the links 12 causes the facing strip 7 to move outwardly as well as longitudinally relative to the backing member 3 while remaining parallel to the latter, to an open position as shown in chain lines in FIG. 2 and as shown in FIG. 3A.

The rib 8 serves also as a stop. Its edge 10 is positioned so that it butts against one end of the slot 4 at the fully open setting. The length of the rib 8 is such that the ventilator can thus be opened to the point where the links 12 have just passed through the position in which they are disposed in the dead-centre position, in order that deliberate longitudinal movement of the facing strip 7 in the reverse direction is required to close the ventilator, and the facing strip 7 cannot normally be slammed shut by a gust of air.

Both the facing strip and the backing member may be made from extrusions of uniform cross-section, e.g., of aluminium, and machined as necessary.

Figure 2:
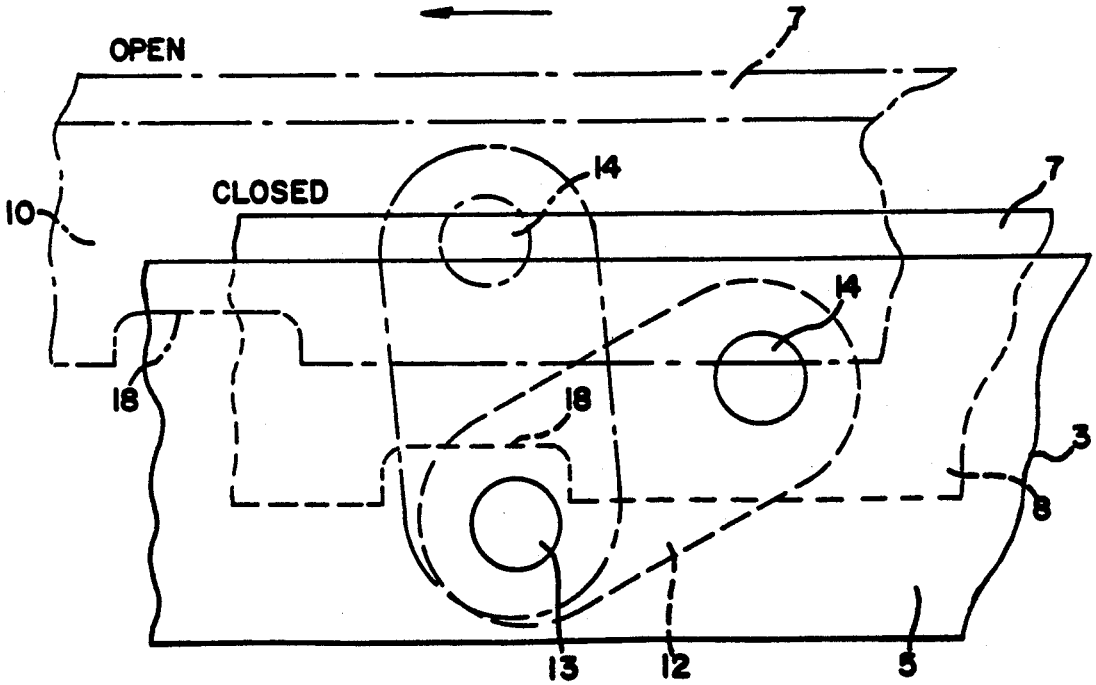
FIG. 2 is a diagrammatic plan view to an increased scale showing the relationship between the backing member and the facing strip and a link in each of the closed and the open positions.
Figure 3A:
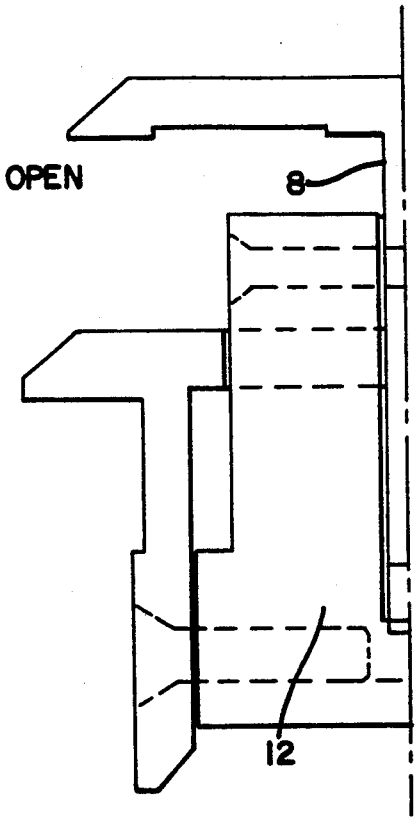
FIG. 3A is a sectional end view of FIG. 2 with the facing strip in the open position and in the closed position to the right of the centre line.
Figure 3B:
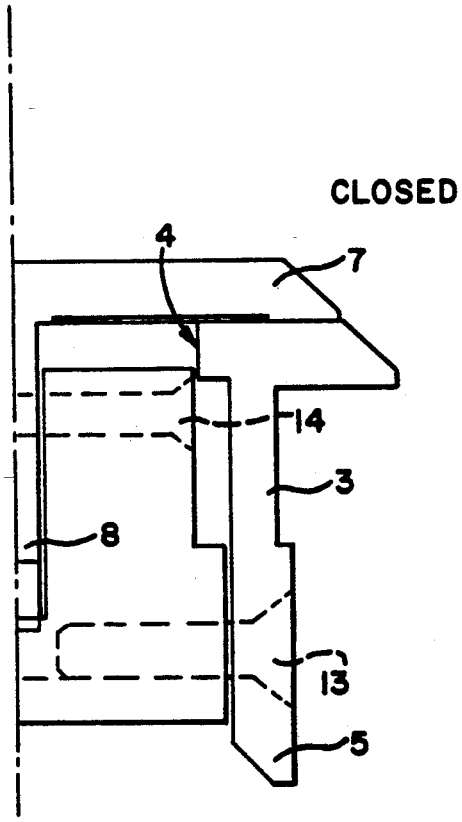
FIG. 3B is a sectional end view of FIG. 2 with the facing strip in the closed position.

Adjacent the pivot pins 13, the rear edge of the rib 8 is cut away at 18 so that in the closed position, shown in solid lines in FIG. 2, the pivot pins do not interfere with the rear edge of the rib and that means that the pivot pins 13 can be mounted close to the outer face of the backing member, which both reduces the dimension of the ventilator in the vertical direction in FIGS. 2 and 3 and incidentally reduces the amount of material necessary in both the backing member and the facing strip.

FIG. 2 also shows how in the closed position in solid lines the links 12 are only a little oblique to the face of the backing member containing the slot. In fact in the example shown in FIG. 2 the angle is about 30 degrees.

In that particular example with links with a length of 10.5 mm between the centres of the pivots 13 and 14, an opening movement of a half that length is permissible, i.e., about 5.2 mm away from the face of the backing member, while the total depth of the backing member need only be about 13 mm. This compact arrangement is achieved by virtue of the cutaway 18 allowing for effective positioning of the pivot pins 13 in the arms 5 of the backing member 3 without interfering with the rib 8 on the facing strip 7 in the closed position.

Accordingly, the present embodiment provides a ventilator having an opening movement of about 40% of the overall ventilator depth. Other embodiments (not shown) could have corresponding values of for example 30% or 50%.

The cutaway portion 18 could be semi-circular rather than rectangular.

The slot ventilator is conveniently installed in a passage in a window frame or sash.

I claim:

1. A slot ventilator comprising:

an elongate backing member having rearwardly-extending first and second flanges and a slot therebetween with side edges therein;

an elongate facing strip movable between an open position and a closed position, said closed position being when said facing strip obstructs said slot and said open, forward position being when said facing strip is forward from said side edges of said slot in said backing member;

a rib extending rearwardly from said facing strip into said slot, said rib comprising a generally flat plate having a longitudinal rear edge spaced from said facing strip and said rear edge having spaced cut-outs passing entirely through said rib; and, a linkage including at least two links, each of which has two ends, said links being spaced from one another, a first link being pivotally connected at one end to said rib and connected by a pivotal connection at the other end to said first and said second flanges, a second link being pivotally connected at one end to said rib and connected by a pivotal connection at the other end to said first and second flanges;

said pivotal connections extending between said first and said second flanges, said cut-outs being positioned and sized to accommodate only said pivotal connections between said first and said second flanges when said facing strip is in said closed position.

2. The slot ventilator as defined in claim 1 in which said links are generally U-shaped with two arms and a base, said rib being positioned between said arms and being pivotally connected to said links near the top of said arm.

3. A slot ventilator as claimed in claim 2 in which when the facing strip is in the closed position, the plane containing the pivotal connections between the each link and the backing member, and the each link and the rib, makes a shallow oblique angle with the general plane of the facing strip.

4. A slot ventilator as claimed in claim 3 in which the said shallow oblique angle is not substantially greater than 30°.

5. A slot ventilator as claimed in claim 4 in which the distance the facing strip moves forwardly from the closed to the open position is at least 30% of the overall depth of the ventilator, measuring from the front surface of the facing strip when in the closed position to the rear of the backing member.

6. A slot ventilator as claimed in claim 5 in which the said distance is substantially 40% of the overall ventilator depth.

7. A slot ventilator comprising:

an elongate backing member having rearwardly-extending first and second flanges and a slot therebetween with side edges therein;

an elongate facing strip movable between an open position and a closed position, said closed position being when said facing strip obstructs said slot and said open position being when said facing strip is forward from said side edges of said slot in said backing member;

a rib extending rearwardly from said facing strip into said slot, said rib being a generally flat plate having a longitudinal rear edge that is spaced from said facing strip, said rear edge having spaced cut-outs passing entirely through said rib; and, a linkage including at least two links, each of which has two ends, said links being spaced from one another, each link being pivotally connected at one end to said rib and connected by a pivotally connection at the other end to said first and second flanges, said pivotal connections extending between said first and second flanges, said cut-outs being positioned and sized to accommodate only said pivotal connections extending between said first and said second flanges when said facing strip is in said closed position, each said link being generally U-shaped with two arms and a base, said rib being positioned between said arms and being pivotally connected to said links near the top of each said arm, and the plane containing said pivotal connections between each said link and said backing member and each said link and said rib makes a generally oblique angle not substantially greater than 30° with the general plane of said facing strip when said facing strip is in said closed position, the distance said facing strip moves forwardly from said closed position to said open position is at least 30 percent of the overall depth of the ventilator, said ventilator depth being the distance from the front surface of said facing strip when in said closed position to the rear of said backing member.

* * * * *